US010541125B2

(12) United States Patent
Miura et al.

(10) Patent No.: US 10,541,125 B2
(45) Date of Patent: Jan. 21, 2020

(54) ION ANALYZER

(71) Applicant: SHIMADZU CORPORATION, Kyoto-shi, Kyoto (JP)

(72) Inventors: Hiroyuki Miura, Kyoto (JP); Hideaki Izumi, Kyoto (JP); Kiyoshi Ogawa, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/226,003

(22) Filed: Dec. 19, 2018

(65) Prior Publication Data

US 2019/0189418 A1 Jun. 20, 2019

(30) Foreign Application Priority Data

Dec. 20, 2017 (JP) ..... 2017-244343
Oct. 5, 2018 (JP) ..... 2018-189685

(51) Int. Cl.
*H01J 49/22* (2006.01)
*H01J 49/40* (2006.01)
*H01J 49/02* (2006.01)

(52) U.S. Cl.
CPC ..... *H01J 49/408* (2013.01); *H01J 49/022* (2013.01); *H01J 49/025* (2013.01)

(58) Field of Classification Search
USPC ..... 250/504 R
See application file for complete search history.

(56) References Cited

U.S. PATENT DOCUMENTS 3,686,683 A * 8/1972 Powers ..... H01J 49/18 315/357
5,696,376 A * 12/1997 Doroshenko ..... H01J 49/424 250/282

(Continued)

FOREIGN PATENT DOCUMENTS

JP 2009-230999 A 10/2009
JP 2012-099424 A 5/2012

(Continued)

OTHER PUBLICATIONS

"MCP (Microchannel Plate) & MCP Assembly", [online], Hamamatsu Photonics K.K., [assessed on Nov. 2, 2017], The Internet <URL:https://www.hamamatsu.com/resources/pdf/etd/MCP_TMCP0002E.pdf>.

*Primary Examiner* — Phillip A Johnston
(74) *Attorney, Agent, or Firm* — Sughrue Mion, PLLC

(57) ABSTRACT

A microchannel plate (MCP) 41 in an ion detection section 4 multiplies electrons. An anode 42 detects those electrons and produces a current signal. An amplifier 44 converts this signal into a voltage signal. A low-pass filter 5A acting as a smoothing section 5 is located at the output end of the amplifier 44. A waveform-shaping time adjuster 6 adjusts the time constant of the low-pass filter 5A beforehand according to the response time of the MCP 41, mass-to-charge ratio of an ion species to be subjected to the measurement, and duration of the spread of the ion species which depends on device-specific parameters. A plurality of peaks which sequentially appear in the detection signal corresponding to one ion species are thereby smoothed into a single broad peak. Thus, the distinguishability between signal waves and noise components is improved.

18 Claims, 5 Drawing Sheets

(56) References Cited

U.S. PATENT DOCUMENTS

| | | | | |
|---|---|---|---|---|
| 5,703,358 | A * | 12/1997 | Hoekman | H01J 49/428 250/282 |
| 6,833,544 | B1 * | 12/2004 | Campbell | H01J 49/4225 250/281 |
| 8,723,128 | B2 * | 5/2014 | Takayama | G01T 1/161 250/363.03 |
| 9,082,602 | B2 | 7/2015 | Shchepunov et al. | |
| 2009/0236517 | A1 | 9/2009 | Suzuki et al. | |
| 2011/0180705 | A1 | 7/2011 | Yamaguchi | |
| 2012/0112060 | A1 | 5/2012 | Kinugawa et al. | |
| 2016/0049286 | A1 * | 2/2016 | Park | H01J 49/063 250/282 |
| 2017/0328863 | A1 | 11/2017 | Yasuno et al. | |

FOREIGN PATENT DOCUMENTS

| | | | |
|---|---|---|---|
| WO | 2010/041296 | A1 | 4/2010 |
| WO | 2016/079780 | A1 | 5/2016 |

* cited by examiner $\Delta t_2 = 0.5ns$ $\Delta t_2 = 1ns$ $\Delta t_2 = 1.5ns$ $\Delta t_2 = 2ns$ $\Delta t_2 = 5ns$

ION ANALYZER

TECHNICAL FIELD

The present invention relates to an ion analyzer, such as a mass spectrometer or ion mobility spectrometer, which includes an ion detector for detecting ions.

BACKGROUND ART

In a time-of-flight mass spectrometer (which is hereinafter abbreviated as "TOFMS"), which is a type of mass spectrometer, ions derived from components contained in a sample are individually given a specific amount of energy and injected into a flight space. After being made to fly a specific distance, the ions are detected, and the time of flight of each ion is measured. Since the flying speed of an ion within the flight space depends on the mass-to-charge ratio (m/z) of the ion, the mass-to-charge ratio of each ion can be determined from the measured time of flight. The mass-resolving power of the TOFMS normally increases with an increase in the distance which the ions are made to fly. However, if ions having the same mass-to-charge ratio are spatially spread in their direction of flight, it will be difficult for different kinds of ions having close mass-to-charge ratios to be separated from each other. Therefore, in order to improve the performance of the device, it is important to achieve both a longer time of flight by increasing the flight distance and the shortest possible period of time during which ions having the same mass-to-charge ratio are detected by the ion detector. This period of time is hereinafter called the "duration".

In the case of a linear TOFMS, in which ions are made to fly linearly, or a reflectron TOFMS, in which ions are made to fly in a round-trip path by means of a reflecting electric field, increasing the flight distance requires the device to be larger in size. In recent years, a type of device called the "multiturn" TOFMS has been developed (for example, see Patent Literature 1, 2 or 4). In a multiturn TOFMS, ions are made to fly multiple times in a closed loop path (such as a substantially circular path, substantially elliptical path, "8"-shaped path) or quasi-loop path (such as a helical path; in the following descriptions, a quasi-loop path is also regarded as one form of the loop path). Such a multiturn system can provide a far longer flight distance within a comparatively small space than the linear or reflectron TOFMS.

The duration of the ions having the same mass-to-charge ratios at the ion detection point depends on various factors, such as the initial state of the ions at the time when the ions are accelerated and introduced into the time-of-flight mass separator, aberration of the ion optical system, and time-resolving power of the ion detection section. Improvements have been achieved in each of those elements. In particular, recently developed ion detectors can operate at extremely high speeds which correspond to response times of sub-nanoseconds. A type of ion detector commonly used for TOFMS is an ion detector employing a microchannel plate (MCP) which generates electrons upon receiving an ion and multiplies the generated electrons (for example, see Patent Literature 3 or Non-Patent Literature 1). As compared to secondary electron multipliers (SEMs), MCPs have a shorter multiplication pathway and are therefore faster in response. Their response time is roughly within a range from 0.4 nsec to 1.5 nsec depending on the individual devices.

CITATION LIST

Patent Literature

Patent Literature 1: JP 2012-99424 A
Patent Literature 2: WO 2010/041296 A
Patent Literature 3: JP 2009-230999 A
Patent Literature 4: U.S. Pat. No. 9,082,602 B
Patent Literature 5: WO 2016/079780 A

Non Patent Literature

Non-Patent Literature 1: "MCP (Microchannel Plate) & MCP Assembly", [online], Hamamatsu Photonics K.K., [assessed on Nov. 2, 2017], the Internet

SUMMARY OF INVENTION

Technical Problem

However, the use of such an ion detector capable of a high-speed response particularly causes a problem as follows.

When ions accumulated within an ion trap or similar device are accelerated by an acceleration voltage and introduced into a flight path, or when ions generated from a matrix assisted laser desorption ionization (MALDI) source or similar device are accelerated and introduced into a flight path, it is inevitable that ions having the same mass-to-charge ratios become spread in their direction of travel to a certain extent due to various factors, such as the variation in the initial position of the ions at the moment of acceleration, variation in the initial energy of the ions, or variation in the initial moving direction of the ions. Therefore, a large number of ions having the same mass-to-charge ratio take a cloud-like form spread in their direction of travel when they are introduced into the flight path (see FIG. 6A).

The ions forming such a cloud have slight differences in velocity. Furthermore, the ions become gradually dispersed during their flight due to the space charge which results from their own electric charges. The longer the flight distance, the greater the extent of the dispersion. Therefore, if a large number of ions having the same mass-to-charge ratio are made to fly a long distance, those ions will be spread in their direction of travel, being divided into clusters as shown in FIG. 6B. The distribution of those ions in the traveling direction has such a form that the amount of ions is highest around the central area and gradually decreases with the increasing distance from that area in both the forward and backward directions. The duration of the ions having the same mass-to-charge ratio depends on the flight distance. For example, it may reach 5 nsec or even longer in the case of the multiturn TOFMS, in which case the duration of the same ion species at the ion detection point becomes longer than the response time of the ion detector. In such a case, the waveform of the detection signal produced by the ion detector will have a plurality of peaks discretely located in the temporal direction, as shown by an example in FIG. 7. The intensity of the peaks decreases with the increasing distance from the central peak. Such a phenomenon is particularly noticeable on ions with comparatively high mass-to-charge ratios since such ions have long flight times. By comparison, ions with lower mass-to-charge ratios have shorter durations. For such ions, the ion detector must be capable of a high-speed response. From such a technical background, the use of an ion detector capable of a high-speed response is indispensable if ions with a wide range of mass-to-charge ratios need to be individually detected with an appropriate duration.

Even an ion detector whose response is rather slow may also produce a detection signal having a waveform with discrete peaks appearing in the previously described manner if the response speed of the ion detector becomes relatively high. Such a situation occurs if the duration of the same ion species at the ion detection point exceeds a previously estimated length due to the aberration of an ion optical system or other factors.

In an ion detector, a noise signal may be mixed in the detection signal due to various causes. A noise signal which enters a circuit or other elements of the ion detector from outside typically has a spike-like form, i.e. a pulsed form with a comparatively short duration. If such a pulse of noise is superposed on a detection signal having the previously described form in which a plurality of peaks having a short duration sequentially appear with their intensity partially lowered, it may be difficult to distinguish between noise components and signal components. This may eventually deteriorate the accuracy of the signal intensity originating from the ions.

The present invention has been developed to solve the previously described problem. Its objective is to provide an ion analyzer in which the signal components in the detection signal corresponding to the amount of ions obtained by detecting ions can be easily distinguished from noise components originating from exogenous noise or other factors, so that the signal intensity can be accurately determined.

Solution to Problem

The present invention developed for solving the previously described problem is an ion analyzer having an ion detection section for generating a detection signal corresponding the amount of incident ion, the ion analyzer including:

a) a signal waveform shaping section which is a smoothing circuit for reducing a higher-frequency component of the detection signal; and b) a time constant adjuster for adjusting the time constant of the smoothing circuit according to at least the duration of an ion species of the same mass-to-charge ratio incident on the ion detection section.

For example, consider a situation in a TOFMS in which a cloud of ion species having the same mass-to-charge ratio enters the ion detection section after being dispersed in the traveling direction during the flight. The signal waveform of the detection signal will be as shown by the solid line in FIG. 4, for example. The duration of the ion species depends on device-specific parameters (e.g. flight distance) and the mass-to-charge ratio of the ion species. Therefore, once the ion species to be subjected to the measurement has been determined, the duration of the ion species can be estimated to a certain extent. For example, its rough value can be determined based on a predetermined calculation formula. On the other hand, the output response time of the ion detection section is also a characteristic parameter of the elements, circuits or the like of the ion detection section.

In the present invention, for example, the time constant adjuster adjusts parameters of the elements constituting the smoothing circuit so that the time constant will be an appropriate value previously determined according to the mass-to-charge ratio of the ion species to be subjected to the measurement as well as other relevant conditions. The simplest form of the smoothing circuit is an RC filter, in which case one or both of the resistance value of the resistor and the capacitance value of the capacitor can be adjusted. Another possible form of the smoothing circuit is a digital filter for performing a filtering process on detection signals digitized through an analogue-to-digital converter, in which case the time constant can be adjusted by changing the coefficients of the digital filter. When the detection signal produced by the ion detection section in response to an incident ion is passed through the smoothing circuit whose time constant has been appropriately adjusted, higher-frequency components of the detection signal are reduced, and a waveform which is approximate to the envelope of a plurality of peak waves in the original detection signal is obtained. That is to say, a single peak having a larger peak width, i.e. a peak having a lower frequency than the waveform of the original detection signal, is obtained for a single ion species.

As one mode of the present invention, the time constant adjuster may be configured to adjust the time constant of the smoothing circuit according to the duration of the ion species of the same mass-to-charge ratio incident on the ion detection section and an output response time which is a characteristic value of the ion detection section.

In this case, in order to obtain a signal waveform which is approximate to the envelope of a plurality of peak waves in the original detection signal in the signal waveform shaping section in the previously described manner, the time constant adjuster may be configured to adjust the time constant of the smoothing circuit to approximately $\sqrt{(\Delta t_1^2+\Delta t_2^2)}$, where $\Delta t_2$ is the duration of the ion species of the same mass-to-charge ratio incident on the ion detection section and $\Delta t_1$ is the output response time of the ion detection section.

According to a study by the present inventor, it is in the case where $\Delta t_2$ is substantially equal to or greater than two times $\Delta t_1$ that the distinction between a true peak and a noise peak in the detection signal becomes arduous. In such a case, $\Delta t_1$ can be ignored in the calculation of the time constant without causing significant influences. Accordingly, as another mode of the present invention, the time constant adjuster may be configured to adjust the time constant of the smoothing circuit to a value approximately equal to the duration ($\Delta t_2$) of the ion species of the same mass-to-charge ratio incident on the ion detection section when, for example, $\Delta t_2 > 2\times\Delta t_1$ is satisfied.

As is evident from the previous description, if the output response time $\Delta t_1$ of the ion detection section is not significantly short as compared to the duration $\Delta t_2$ of the ion species of the same mass-to-charge ratio incident on the ion detection section, i.e. if the response of the ion detection section is rather slow, it is unnecessary to smooth the detection signal. In other words, the present invention is particularly useful for an ion analyzer having an ion-detection section which has a high response speed. Examples of such an ion detection section include ion detectors employing a microchannel plate, electron multiplier, avalanche photodiode, or Faraday cup.

As described earlier, the present invention is useful in the case where the same ion species is dispersed in the traveling direction of the ions at the point in time when the ions enter the ion detection section. Such a situation is likely to occur in a TOFMS which has a long flight distance for separating ions according to their mass-to-charge ratios. Therefore, a time-of-flight mass spectrometer can be considered as one preferable form of the ion analyzer according to the present invention.

Among the various types of TOFMS, the multiturn TOFMS described earlier allows the flight distance to be longer than in the linear or reflectron TOFMS both of which are more commonly used. However, due to the long flight distance, the multiturn TOFMS tends to allow the ion species having the same mass-to-charge ratio to be dispersed to a comparatively large extent in the traveling direction during their flight, although those flying ions should ideally be always located on the same plane perpendicular to the flight path. Therefore, the multiturn TOFMS can be considered as a more preferable form of the ion analyzer according to the present invention.

A multiturn TOFMS, depending on its configuration or structure, may possibly allow the flight distance or flight time to be varied according to the mass-to-charge-ratio range of the ions to be subjected to the measurement, mass-resolving power to be achieved, or other factors. In such a device, the state of the dispersion of the same ion species at the point in time when the ions enter the ion detection section depends on the mass-to-charge ratio of that ion species or other factors.

Accordingly, the ion analyzer according to the present invention may further include:

a multiturn time-of-flight mass separator; and a controller for controlling the time constant adjuster to change the time constant of the smoothing circuit according to one or more values selected from a mass-to-charge-ratio range, amount, number of turns, flight distance, and flight time of an ion to be introduced into and analyzed by the multiturn time-of-flight mass separator.

According to this configuration, the detection signal can be appropriately smoothed according to the state of the dispersion of the same ion species at the point in time when the ions enter the ion detection section, and a single smooth peak which fits a plurality of peaks originating from the same ion species can be obtained.

The ion analyzer according to the present invention is applicable not only in TOFMS or other types of mass spectrometers, but also in an ion mobility spectrometer for separating ions from each other by the detection time which corresponds to the ion mobility of each ion.

In ion mobility spectrometers, a Faraday-cup detector is often used as the ion detection section. In that case, the response time of the detection system is normally a device-specific parameter which is determined by the Faraday cup and an amplification circuit. On the other hand, the extent of the temporal dispersion of the same ion species depends on various factors, such as the device parameters (e.g. the flow velocity of the medium gas used for the mobility spectrometry, the period of time for a shutter gate to be opened to allow ions to pass through in a pulsed form, and the drift voltage or drift distance for the mobility measurement) and the ion mobility which is mainly determined by the ion species, medium-gas species and temperature. The relationship of the response time of the detection system to the degree of ion separation is opposite to the relationship of the response time to the capability to distinguish between an ion intensity signal and a noise signal. The present invention, which allows the time constant to be appropriately adjusted according to the mobility and device conditions, will be useful to deal with such a trade-off.

Advantageous Effects of the Invention

For example, in the case where the ion analyzer according to the present invention is applied in a TOFMS which separates ions according to their mass-to-charge ratios by making the ions fly, if the ion species having the same mass-to-charge ratio is spread in the traveling direction of the ions during their flight before reaching the ion detection section, the ion analyzer generates a signal waveform having a single broad peak corresponding to the duration of the spread of the ion species. Accordingly, a waveform whose signal intensity corresponds to the amount of ions can be easily distinguished from higher-frequency noise waveforms originating from exogenous noise or other factors, and a correct ion intensity free from such noise factors can be determined.

DESCRIPTION OF EMBODIMENTS

One embodiment of the ion analyzer according to the present invention is hereinafter described with reference to the attached drawings.

Figure 1:
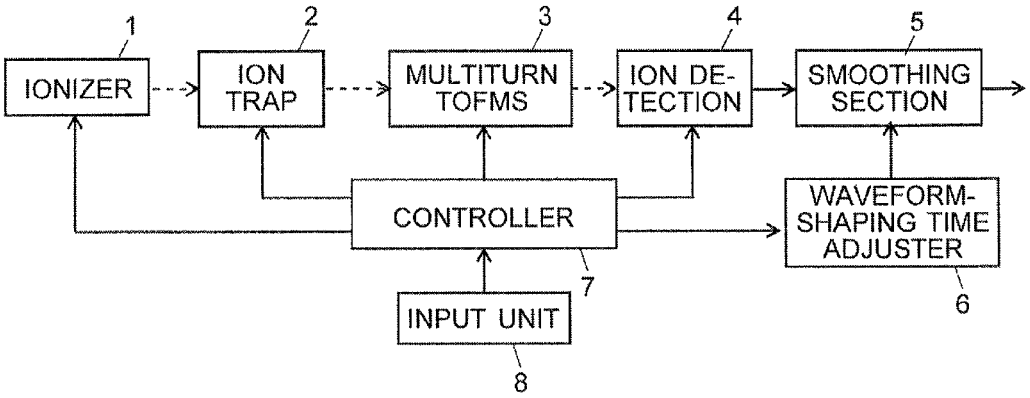
FIG. 1 is a schematic block configuration diagram of a multiturn TOFMS according to one embodiment of the present invention.
Figure 2:
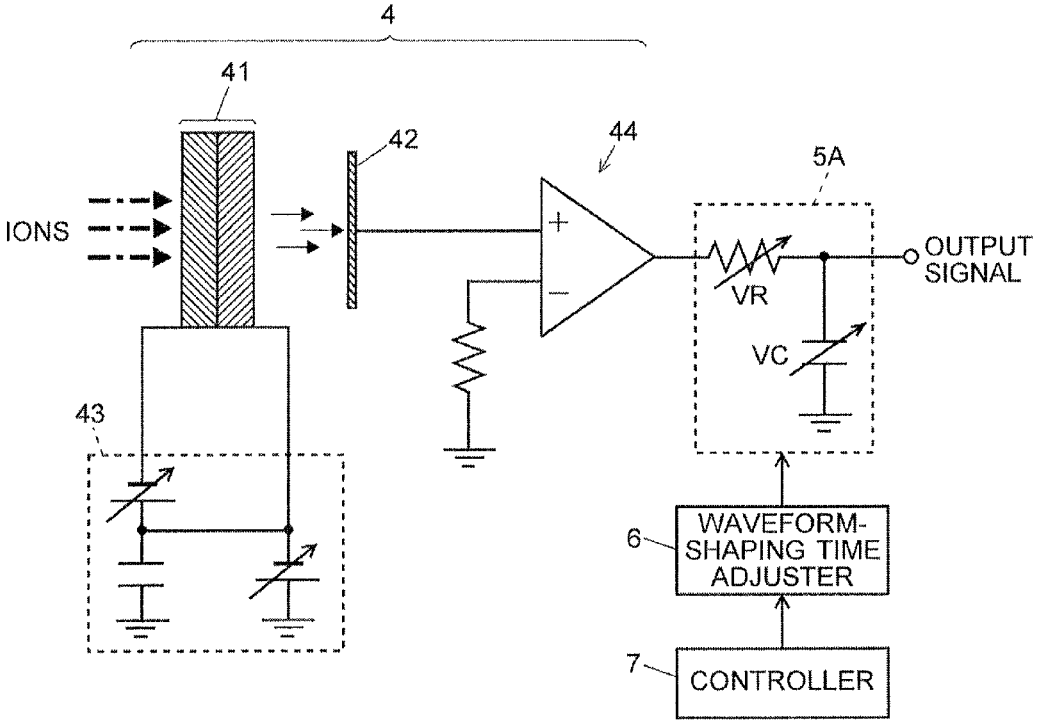
FIG. 2 is a schematic configuration diagram of the ion detection section and the smoothing section in the present embodiment.
Figure 4:
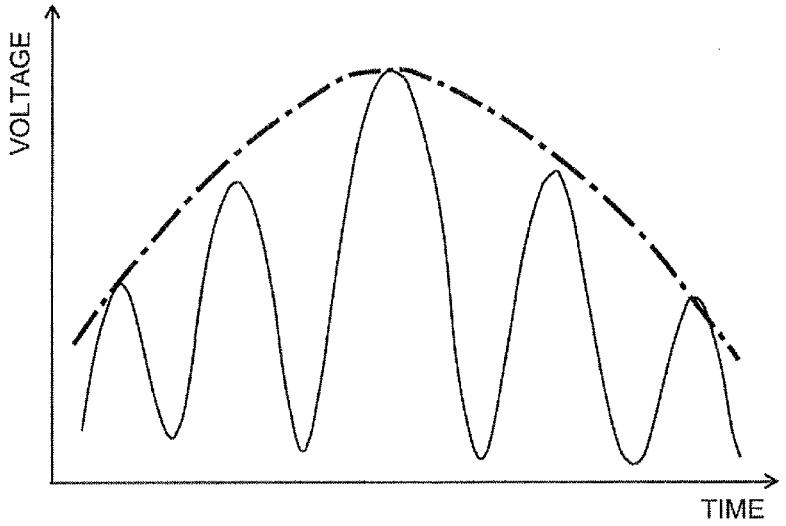
FIG. 4 is a waveform diagram for explaining an operation in the ion detection section and the smoothing section in the present embodiment.

FIG. 1 is a schematic block configuration diagram of a multiturn TOFMS according to the present embodiment. FIG. 2 is a schematic configuration diagram of an ion detection section and a smoothing section. FIG. 4 is the waveform diagram for explaining an operation in the ion detection section and the smoothing section.

The multiturn TOFMS according to the present embodiment includes: an ionizer 1 for ionizing each component in a sample; an ion trap 2 for temporarily holding ions generated by the ionizer 1; a multiturn mass separator 3 for receiving various ions released from the ion trap 2 and for making those ions fly along a predetermined path to separate them according to their mass-to-charge ratios; an ion detection section 4 for sequentially detecting ions separated from each other by the multiturn mass separator 3; a smoothing section 5 for smoothing detection signals produced by the ion detection section 4; a waveform-shaping time adjuster 6 for adjusting the time constant in the smoothing section 5; a controller 7 for controlling the operations of the previously mentioned components; and an input unit 8 for allowing a user to set measurement conditions and other necessary items of information.

A brief description of the measurement operation in the present TOFMS is as follows: The ionizer 1 ionizes various components in a sample introduced into it. The generated ions are temporarily held within an ion trap 2, which is either a linear type or three-dimensional quadrupole type of ion trap. Within the ion trap, for example, the ions which fall within a mass-to-charge-ratio range to be subjected to the measurement are selected. Since there is a limitation on the amount of ions that can be introduced into the multiturn mass separator 3, an operation for reducing the amount of ions by partially discharging the ions is also performed in the ion trap 2 if there is an excessive amount of ions to be subjected to the measurement. An operation for dissociating an ion by collision induced dissociation or similar techniques may also be performed in the ion trap 2.

The ions temporarily held in the ion trap 2 are ejected from the ion trap 2 at a predetermined timing. The ejected ions are introduced into the multiturn mass separator 3. After flying along the flight path formed by the multiturn mass separator 3, the ions enter the ion detection section 4. While flying along the flight path, ion species having different mass-to-charge ratios are separated from each other and sequentially enter the ion detection section 4, having a time difference from each other. There are various possible configurations and structures for the multiturn mass separator 3, as described in Patent Literature 1, 2 or 4 for example. That is to say, there is no specific limitation on the shape of the path in which the ions are made to fly as well as the shape, structure, number and other aspects of the electrodes which form an electric field for making the ions fly. The ion detection section 4 produces a detection signal corresponding to the amount of incident ions. The smoothing section 5 smooths the detection signal and outputs the obtained signal, as will be described later. Though not shown, this output signal is sent to a data processor. The data processor converts the time of flight into mass-to-charge ratio and creates a mass spectrum showing the relationship between the mass-to-charge ratio and the ion intensity.

The configuration and operation of the ion detection section 4 and the smoothing section 5 are hereinafter described in detail.

The ion detection section 4 includes: a microchannel plate (MCP) 41 for generating electrons in response to an incident ion and multiplying the generated electrons; an anode 42, which is a flat metal plate, for collecting electrons released from the MCP 41; a floating power source 43 for generating a high direct-current voltage for driving the MCP 41; and an amplifier 44 for converting a current signal generated by the electrons which have reached the anode 42 into a voltage signal and amplifying the voltage signal. The MCP 41 in the present embodiment has a two-stage structure. The smoothing section 5 in FIG. 1 is a low-pass filter 5A located at the output end of the amplifier 44. The waveform-shaping time adjuster 6 adjusts one or both of the resistance value of the resistor (variable resistor) VR and the capacitance value of the capacitor (variable capacitor) VC constituting the low-pass filter 5A. The controller 7 sends the waveform-shaping time adjuster 6 the mass-to-charge ratio of an ion to be subjected to the measurement as well as other necessary information when performing an analysis according to the analysis program of the TOFMS.

An operation of the ion detection section 4 and the low-pass filter 5A is hereinafter described.

The following description assumes the case where a precise mass-to-charge ratio for an ion having a roughly known mass-to-charge ratio is determined by using a multiturn TOFMS.

Figure 6A:
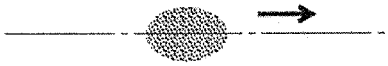
FIGS. 6A and 6B are model diagrams for explaining the state of the spread of ions flying in a common multiturn TOFMS.
Figure 6B:
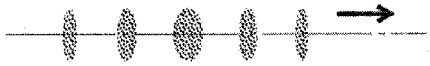
Figure 7:
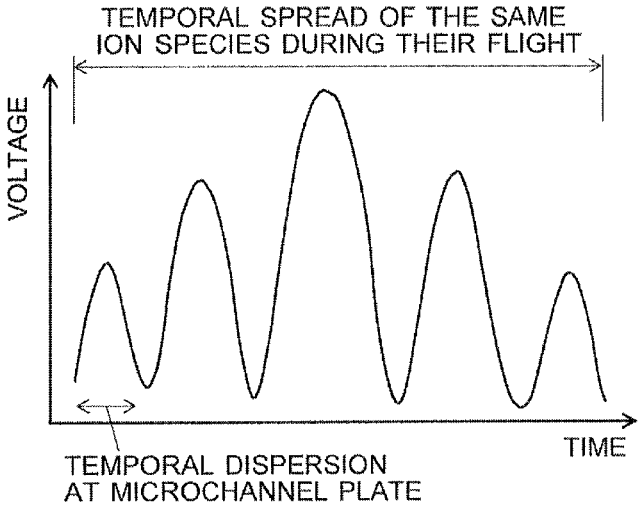
FIG. 7 is a graph showing one example of the waveform of the detection signal of a conventional microchannel-plate detector.

Upon receiving a command from the controller 7, the power source 43 applies a high appropriately-adjusted direct-current voltage to the MCP 41. As shown, when ions enter the MCP 41, the electrons generated in response to the ions are multiplied, and a large number of electrons are released. Those ions strike the anode 42, and an electric current whose amount corresponds to that of the electrons is sent to the amplifier 44. The amplifier 44 converts the current signal into a voltage signal and outputs this voltage. Such a response of the ion detection section 4 is speedy. Therefore, if a cloud of ions having the same mass to-charge ratio is spread in their direction of travel in the multiturn TOFMS as shown in FIG. 6B before entering the MCP 41, the waveform of the detection signal produced by the amplifier 44 will have multiple discrete peaks, for example, as indicated by the solid line in FIG. 4.

The duration of the same ion species entering the MCP 41 depends on specific parameters to the TOFMS and those related to the control performed in the TOFMS for the measurement, such as the flight distance (number of turns of the loop path), configuration of the ion ejection source (e.g. ion trap 2), and method of application of the voltage for ejecting ions from the ion ejection source. The duration also depends on the mass-to-charge ratio of the ion to be subjected to the measurement. The controller 7 informs the waveform-shaping time adjuster 6 of a rough mass-to-charge ratio (mass-to-charge-ratio range) of the ion species as the measurement target beforehand (before the execution of the measurement), for example, based on the information set by a user through the input unit 8.

The waveform-shaping time adjuster 6 calculates the time constant for the ion species to be subjected to the measurement, based on a calculation formula (or the like) which is previously determined according to the device-specific parameters mentioned earlier and other pieces of information. The waveform-shaping time adjuster 6 adjusts one or both of the resistance value of the resistor VR and the capacitance value of the capacitor VC constituting the low-pass filter 5A, so as to achieve the calculated time constant. More specifically, the waveform-shaping time adjuster 6 performs the following processing.

Let $\Delta t_1$ denote the output response time of the MCP 41. For an ion species which is to be subjected to the measurement, the waveform-shaping time adjuster 6 estimates the duration $\Delta t_2$ of the ion species based on the rough mass-to-charge ratio (or mass-to-charge-ratio range) of the ion species. Using the following equation (1), the waveform-shaping time adjuster 6 determines the time constant tc of the low-pass filter 5A and calculates the resistance value of the resistor VR and/or the capacitance value of the capacitor VC from the time constant tc.

$$tc=\sqrt{(\Delta t_1^2+\Delta t_2^2)} \quad (1)$$

Subsequently, the waveform-shaping time adjuster 6 adjusts the resistance value of the resistor VR and/or the capacitance value of the capacitor VC to the calculated value or values.

If a signal having a waveform with a series of peaks as shown by the solid line in FIG. 4 is passed through the low-pass filter 5A whose time constant has been adjusted in the previously described manner, its higher-frequency components are cut (in other words, the signal components are integrated), and a smoothed output signal as shown by the long-dashed short-dashed line in FIG. 4 is obtained. That is to say, the output signal forms a single large peak, i.e. a broad peak in an entirely integrated form, with the series of peaks corresponding to one ion species barely observable. The signal whose waveform is shaped in this manner by the low-pass filter 5A is fed to the subsequent circuits. Such a signal originating from the ions which have entered the MCP 41 can be easily distinguished from pulsed signals which may possibly be mixed in the signal.

The previously described waveform shaping is needed when the ratio of the duration $\Delta t_2$ of the ion species to the output response time $\Delta t_1$ of the MCP 41 is equal to or higher than a certain threshold. To determine this threshold, a simulation using a random function has been performed as follows: Consider the situation in which a signal having a random Gaussian waveform has been detected with a waveform expressed by equation (2):

$$rg(x, n, a) = n \times \exp\left(-4\log 2 \times \left(\frac{x}{a}\right)^2\right) - \sqrt{n \times \exp\left(-4\log 2 \times \left(\frac{x}{a}\right)^2\right)} + 2 \times R(x) \times \sqrt{n \times \exp\left(-4\log 2 \times \left(\frac{x}{a}\right)^2\right)} + R(x) \quad (2)$$

Figure 8A:
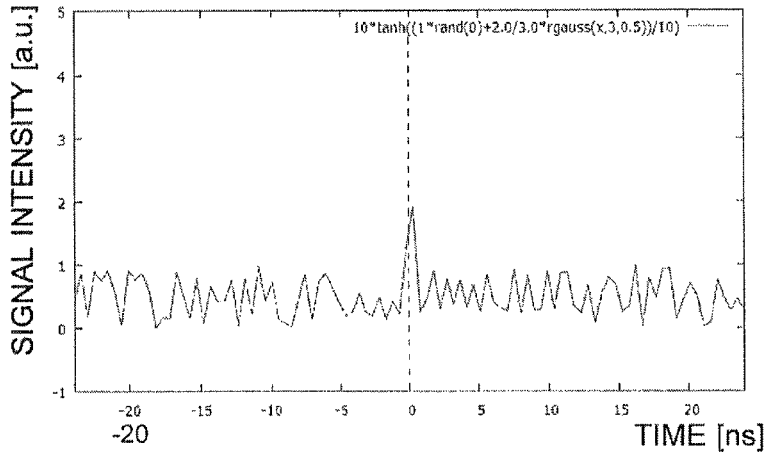
FIGS. 8A-8C are graphs showing simulation results of the signal waveform of a detection signal produced by a microchannel-plate detector, with a random noise component superposed on the signal.
Figure 8B:
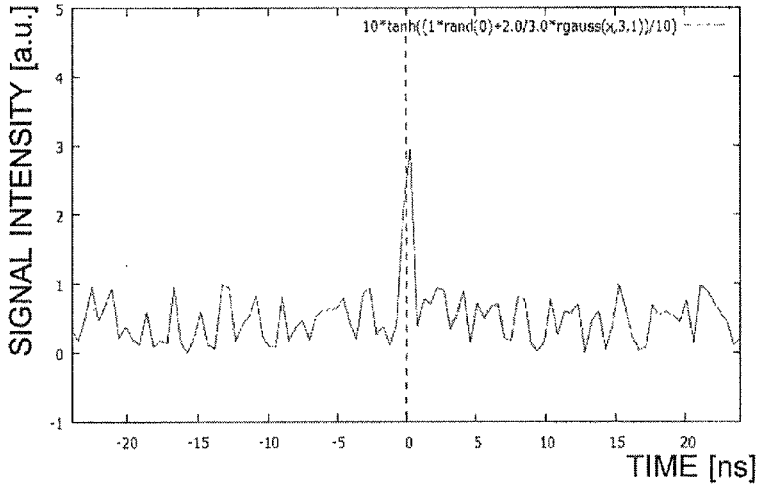
Figure 8C:
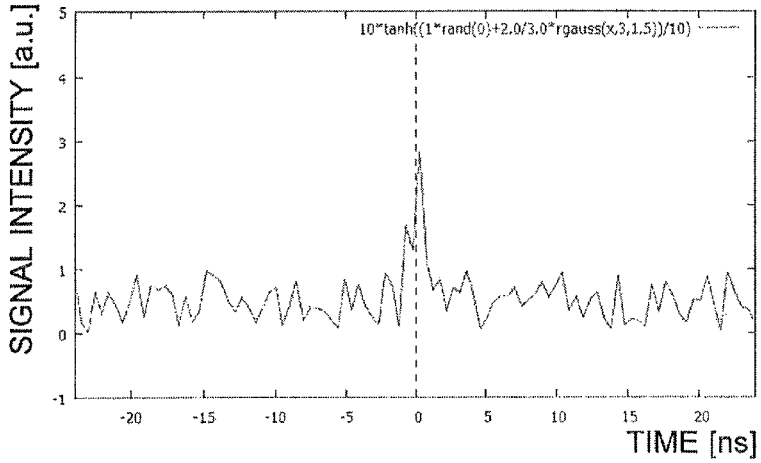
Figure 9A:
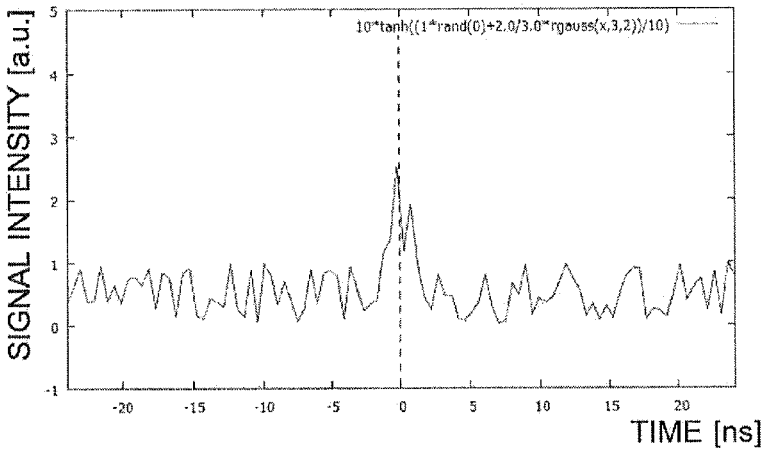
FIGS. 9A and 9B are graphs showing simulation results of the signal waveform of a detection signal produced by a microchannel-plate detector, with a random noise component superposed on the signal.
Figure 9B:
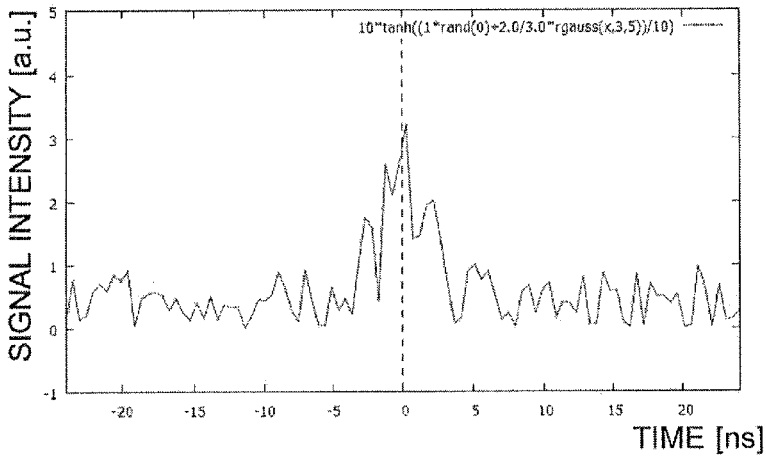

Equation (2) simulates a signal having intensity n and half-value width a with respect to variable x, on which a noise signal expressed by random function R(x) having an intensity of 1 and duration of 0.5 ns is superposed. The duration of the random function is assumed to be equal to the output response time $\Delta t_1$ of the MCP 41. On the assumption that the SN ratio is 3 and the signal is detected at t=0, the waveform has been calculated under the condition that the duration $\Delta t_2$ of the ion species is set to 0.5 ns, 1 ns, 1.5 ns, 2 ns and 5 ns. The results are as shown in FIGS. 8A, 8B and 8C as well as FIGS. 9A and 9B, respectively.

Those graphs demonstrate that the detection signal can be satisfactorily distinguished from the noise signal when the duration $\Delta t_2$ of the ion species is approximately equal to or shorter than 1 ns, i.e. two times the output response time $\Delta t_1$ of the MCP 41. By comparison, when $\Delta t_2$ is approximately two to three times $\Delta t_1$ or greater, the waveform of the detection signal is split into multiple peaks. In such a situation, it may be difficult to distinguish some of those peaks from noise peaks. Accordingly, as a rough guide, it is reasonable to consider that the previously described smoothing process using the low-pass filter is useful when $\Delta t_2$ is approximately equal to or greater than two times $\Delta t_1$.

It should be noted that using an excessively small time constant tc for the ion duration $\Delta t_2$ or output response time $\Delta t_1$ causes the problem that the waveform of the series of peaks cannot be sufficiently smoothed, whereas using a time constant tc which is slightly larger than an optimum value causes no practical problem. Therefore, when $\Delta t_2$ is approximately equal to or larger than two times $\Delta t_1$, it is possible to ignore $\Delta t_1$, which means that equation (1) can be changed into an extremely simple form: $tc=t_2$. That is to say, the time constant tc of the low-pass filter 5A can be roughly set to be the estimated value of the ion duration $\Delta t_2$.

If the duration $\Delta t_2$ of the ion species having the same mass-to-charge ratio does not substantially change, it is unnecessary to adjust the time constant of the low-pass filter 5A. By comparison, if the duration $\Delta t_2$ of the ion species having the same mass-to-charge ratio can significantly change, it is preferable to adjust the time constant of the low-pass filter 5A according to the parameters which affect the duration $\Delta t_2$. Specifically, the duration $\Delta t_2$ of the same ion species in a multiturn TOFMS tends to increase with an increase in the time of flight of that ion species. Furthermore, the duration $\Delta t_2$ of the same ion species also tends to increase with the amount of ions, since the influence of the space-charge effect increases with the amount of ions. With these factors considered, it is preferable to configure the controller 7 to inform the waveform-shaping time adjuster 6 of the mass-to-charge-ratio range of the ions to be subjected to the measurement, flight distance (number of turns of the flight path), time of flight, amount of ions and other pieces of information so that the waveform-shaping time adjuster 6 can appropriately change the time constant of the low-pass filter 5A according to the provided information.

In a measurement using a multiturn TOFMS, when a mass spectrum covering a wide range of mass-to-charge ratios needs to be obtained, it is often the case that the entire mass-to-charge-ratio range is divided into a plurality of narrower mass-to-charge-ratio ranges, and the measurement is performed for each of the narrow mass-to-charge-ratio ranges. In that case, the flight distance, or the number of turns of the flight path, may be varied for each narrow mass-to-charge-ratio range so that the time of flight will be roughly equalized regardless of the narrow mass-to-charge-ratio range. In that case, it is preferable that the time constant tc for a longer flight distance, i.e. for a narrow mass-to-charge-ratio range within which the ions to be subjected to the measurement have relatively large mass-to-charge ratios, be set at a larger value than for a narrow mass-to-charge-ratio range within which the ions to be subjected to the measurement have relatively small mass-to-charge ratios. Such a setting appropriately reduces the influence of the spatial dispersion of the same ion species and enables the measurement to be performed with a high level of sensitivity and accuracy regardless of the narrow mass-to-charge-ratio range.

Figure 3:
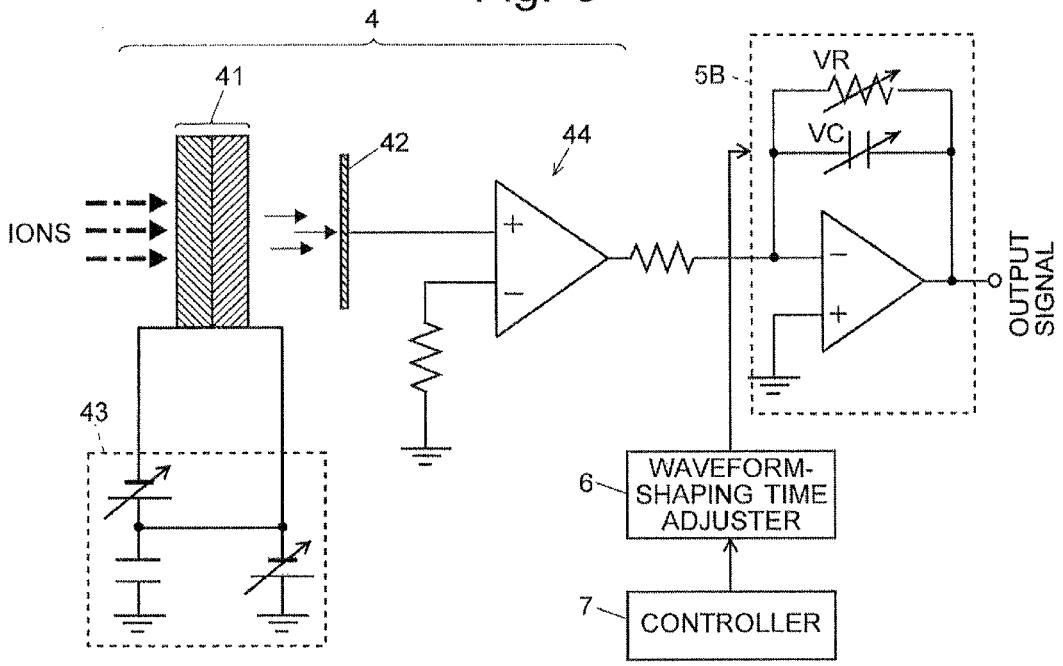
FIG. 3 is a schematic configuration diagram of the ion detection section and the smoothing section in another embodiment.

FIG. 3 is a schematic configuration diagram of the ion detection section and the smoothing section in another embodiment of the present invention. The components which are identical or correspond to those shown in FIG. 2 are denoted by the same reference signs. In the present embodiment, a low-pass filter 5B employing an operational amplifier is used as the smoothing section 5 in FIG. 1. Similar to the previous embodiment, the time constant of the low-pass filter 5B can be adjusted through the resistance value of the resistor VR and the capacitance value of the capacitor VC. The output voltage will also be basically similar to the previously described one.

The waveform-shaping time adjuster 6 may be a mechanism for allowing an operator to manually adjust the variable resistor and variable capacitor constituting the low-pass filter 5A or 5B. In order to allow for the adjustment of the time constant according to the measurement parameters and other related factors in the previously described manner, the waveform-shaping time adjuster 6 must be configured so that the time constant of the low-pass filter 5A or 5B (smoothing section 5) can be adaptively (dynamically) adjusted.

In the case where the time constant of the smoothing section 5 is frequently changed, it is preferable to configure the smoothing section 5 which includes an analogue-to-digital converter capable of a high-speed operation and a digital filter, instead of using the low-pass filter 5A or 5B which is an analogue circuit including circuit elements whose constants are variable. In that case, a computer or digital signal processor configured to set a plurality of coefficients which determine the frequency characteristics of the digital filter can be used as the waveform-shaping time adjuster 6. This waveform-shaping time adjuster 6 can shape the waveform of the detection signal by controlling the frequency characteristics of the digital filter according to pre-installed software or firmware. Although the low-pass filters used in the configurations shown in FIGS. 1 and 3 are first-order filters, it is naturally possible to use a second-order or higher-order filter.

The previously described effect obtained by smoothing the detection signal from the ion detection section 4 by the smoothing section 5 can be recognized in any type of TOFMS in which the temporal spread of a cluster of ions becomes considerably large as compared to the response time of the ion detection section 4, although the smoothing is particularly useful in a multiturn TOFMS or other types of TOFMS in which ions are made to fly a long distance. If the previously described technique is applied in such a TOFMS, detection signals produced by the ion detection section upon detecting a cluster of ions from the mass separator can be distinguished from noise components and correctly evaluated. The previously described problem of the detection signals being difficult to be distinguished from noise components is not limited to multiturn TOFMSs; such a problem always occurs at high mass-to-charge ratios if a high-speed ion detector is selected in order to improve the mass-resolving power for ions with low mass-to-charge ratios. A conventional solution to this problem is to increase the number of accumulations of the detection signals to make the signals more distinguishable from noise components. If the present invention is used, the distinction between the detection signals and noise components can be achieved with a smaller number of accumulations.

Accordingly, the present invention is applicable not only in a TOFMS employing a microchannel-plate detector but also in a TOFMS in which a detector employing an electron multiplier or avalanche photodiode is installed.

Figure 5:
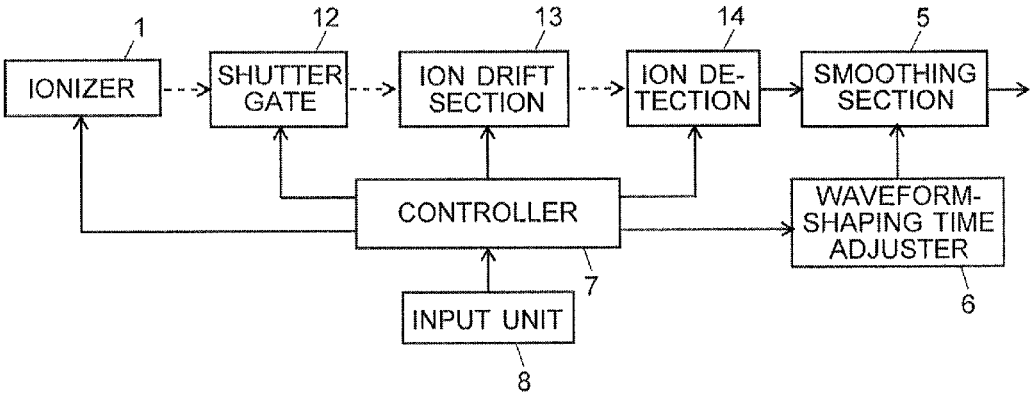
FIG. 5 is a schematic block configuration diagram of an ion mobility spectrometer according to another embodiment of the present invention.

The present invention is not limited to mass spectrometers. It may also be applied in an ion mobility spectrometer including a Faraday-cup detector capable of a high-speed response. FIG. 5 is a schematic block configuration diagram of an ion mobility spectrometer according to one embodiment of the present invention (for example, see Patent Literature 5).

In this ion mobility spectrometer, various ions generated in an ionizer 1 are temporarily blocked by a shutter gate 12 and collected in front of this gate. When the shutter gate 12 is subsequently opened for a short period of time, the collected ions are simultaneously introduced into an ion drift section 13 and fly through the drift space. During this flight, the ions are separated from each other according to the ion mobility which mainly depends on the size of the ion. The separated ions sequentially reach an ion detection section 14. As in the previous embodiment, the same species of ions (i.e. a kind of ions having the same ion mobility) which should simultaneously reach the ion detection section 14 have a certain duration, and the detection signal originating from those ions has a waveform showing a series of peaks, as described earlier. Such a detection signal corresponding to the same ion species can be converted into a signal forming a single large peak by appropriately selecting the time constant in the smoothing section 5. Thus, the detection signals can be distinguished from noise components and correctly evaluated.

Needless to say, the present invention can evidently be applied in an ion mobility-mass spectrometer in which ions are initially separated according to their ion mobilities and further separated according to their mass-to-charge ratios, if the previously described problem similarly occurs due to an ion detection section having an excessively short response time as compared to the duration of the same kind of ions at the point of time where the ions enter the ion detector.

Any of the previously described embodiments and their variations is a mere example of the present invention, and any modification, change or addition appropriately made within the spirit of the present invention will evidently fall within the scope of claims of the present application.

REFERENCE SIGNS LIST

1 . . . Ionizer
2 . . . Ion Trap
3 . . . Multiturn Mass Separator
4, 14 . . . Ion Detection Section
41 . . . Microchannel Plate (MCP)
42 . . . Anode
43 . . . Power Source
44 . . . Amplifier
5 . . . Smoothing Section
5A, 5B . . . Low-Pass Filter
6 . . . Waveform-Shaping Time Adjuster
7 . . . Controller
8 . . . Input Unit
12 . . . Shutter Gate
13 . . . Ion Drift Section

The invention claimed is:

1. An ion analyzer having an ion detection section for generating a detection signal corresponding an amount of incident ion, the ion analyzer comprising:

a) a signal waveform shaping section which is a smoothing circuit for reducing a higher-frequency component of the detection signal; and b) a time constant adjuster for adjusting a time constant of the smoothing circuit according to at least a duration of an ion species of a same mass-to-charge ratio incident on the ion detection section.

2. The ion analyzer according to claim 1, wherein:

the time constant adjuster is configured to adjust the time constant of the smoothing circuit according to the duration of the ion species of the same mass-to-charge ratio incident on the ion detection section and an output response time which is a characteristic value of the ion detection section.

3. The ion analyzer according to claim 2, wherein:

the time constant adjuster is configured to adjust the time constant of the smoothing circuit to approximately $\sqrt{(\Delta t_1^2+\Delta t_2^2)}$, where $\Delta t_2$ is the duration of the ion species of the same mass-to-charge ratio incident on the ion detection section and $\Delta t_1$ is the output response time of the ion detection section.

4. The ion analyzer according to claim 1, wherein:

the time constant adjuster is configured to adjust the time constant of the smoothing circuit to a value approximately equal to the duration of the ion species of the same mass-to-charge ratio incident on the ion detection section.

5. The ion analyzer according to claim 4, wherein:

the time constant adjuster is configured to adjust the time constant of the smoothing circuit to a value approximately equal to the duration of the ion species of the same mass-to-charge ratio incident on the ion detection section when $\Delta t_2>2\times\Delta t_1$ is satisfied, where $\Delta t_2$ is the duration of the ion species of the same mass-to-charge ratio incident on the ion detection section and $\Delta t_1$ is the output response time of the ion detection section.

6. The ion analyzer according to claim 1, wherein:
the ion detection section is a microchannel-plate detector.

7. The ion analyzer according to claim 6, wherein:
the ion analyzer is a time-of-flight mass spectrometer.

8. The ion analyzer according to claim 7, further comprising:

a multiturn time-of-flight mass separator; and a controller for controlling the time constant adjuster to change the time constant of the smoothing circuit according to one or more values selected from a mass-to-charge-ratio range, amount, number of turns, flight distance, and flight time of an ion to be introduced into and analyzed by the multiturn time-of-flight mass separator.

9. The ion analyzer according to claim 1, wherein:
the ion detection section is a Faraday-cup detector.

10. The ion analyzer according to claim 9, wherein:
the ion analyzer is an ion mobility spectrometer.

11. The ion analyzer according to claim 2, wherein:
the ion detection section is a microchannel-plate detector.

12. The ion analyzer according to claim 3, wherein:
the ion detection section is a microchannel-plate detector.

13. The ion analyzer according to claim 4, wherein:
the ion detection section is a microchannel-plate detector.

14. The ion analyzer according to claim 5, wherein:
the ion detection section is a microchannel-plate detector.

15. The ion analyzer according to claim 11, wherein:
the ion analyzer is a time-of-flight mass spectrometer.

16. The ion analyzer according to claim 12, wherein:
the ion analyzer is a time-of-flight mass spectrometer.

17. The ion analyzer according to claim 13, wherein:
the ion analyzer is a time-of-flight mass spectrometer.

18. The ion analyzer according to claim 14, wherein:
the ion analyzer is a time-of-flight mass spectrometer.

* * * * *